United States Patent [19]

Hausler

[11] 4,407,514

[45] Oct. 4, 1983

[54] WELLHEAD CASING PACKING SUPPORT

[75] Inventor: Frederick A. Hausler, Shreveport, La.

[73] Assignee: ACF Industries, Incorporated, New York, N.Y.

[21] Appl. No.: 453,555

[22] Filed: Dec. 27, 1982

[51] Int. Cl.[3] ..... F16J 15/06; E21B 33/12

[52] U.S. Cl. ..... 277/117; 277/166; 277/189; 277/192; 277/190; 166/124; 166/138

[58] Field of Search ..... 277/104, 108, 117–122, 277/124, 166, 178, 188 R, 105, 188 A, 189, 106, 192, 193, 199, 190, 116.8; 166/123, 124, 134, 138, 140

[56] References Cited

U.S. PATENT DOCUMENTS

| | | | |
|---|---|---|---|
| 1,804,619 | 5/1931 | Humason | 277/208 X |
| 1,865,121 | 6/1932 | Lotton | 277/189 |
| 2,683,490 | 7/1954 | Brown | 166/140 X |
| 2,720,267 | 10/1955 | Brown | 166/138 X |
| 3,024,845 | 3/1962 | Conrad | 166/123 |
| 3,096,824 | 7/1963 | Brown | 166/138 X |
| 3,588,130 | 6/1971 | Fowler et al. | 277/116.8 |
| 4,240,561 | 12/1980 | Hagstrom et al. | 277/119 X |

*Primary Examiner*—Robert S. Ward, Jr.

*Attorney, Agent, or Firm*—Marvin J. Marnock

[57] ABSTRACT

A packing support assembly (10) which is sleeved about a well casing ("C"), or the like, and secured thereto without the need for piercing the casing wall or welding thereto. The support assembly (10) comprises a support ring (12) which is sleeved about the casing ("C") and secured thereto by a gripping means in the form of a plurality of clamping segments (14) having serrated surfaces (40) adapted to grip the external wall of the casing ("C"). The clamping segments (14) are held in an unactivated position by retaining screws (46) which secure the clamping segments (14) to the support ring (12). To activate, the clamping segments (14) are wedged inwardly to grip the casing ("C") by a plurality of activating pins (54) which are threadably received into the bottom of the support ring (12). The support ring (12) is provided with an internal wedging surface (26) which is slidably engagable with cooperating wedging surfaces (44) on the exterior of the clamping segments (14) upon rotation of the activating pins (54). The gripping force is adjustable as determined by the degree and method of turning the activating pins (54). The upper annular edge (64) of the support ring (12) is configured to support an annular packing, or the like, thereon.

5 Claims, 6 Drawing Figures

WELLHEAD CASING PACKING SUPPORT

BACKGROUND OF THE INVENTION

This invention relates to a support apparatus for external mounting on a well casing or other cylindrical member of circular cross-section and, more particularly, to a packing support for mounting on a well casing to support a packing which seals the annulus between the casing and the wellhead or the bore wall of an outer casing.

To secure structures such as packing assemblies to the exterior of a casing or tubing, it is sometimes desirable or necessary to provide a support therefor which can be secured to the casing without piercing the casing wall or welding thereto and without attachment to an external support such as, for example, a wellhead or an outer casing. This latter feature is particularly important with packing assemblies which are used for sealing between a casing and a wellhead such as a geothermal wellhead wherein the casing will characteristically move longitudinally within the wellhead in response to thermal conditions and temperature changes associated therewith. It is also essential when used as a packing support that the packing support assembly grip the casing very securely and be immovable thereon since such packing are usually subjected to very great compressive forces.

Heretofore, packing supports have been utilized that encompass a single annular ring sleeved about a well casing and secured in place by a plurality of set screws directed radially inwards towards the casing. However, these supports have frequently been unable to sustain an adequate grip on the casing due to the extreme pressures and forces present in a geothermal well. Packing supports which are capable of withstanding these high forces have been designed and an example of such a packing support is shown in U.S. patent application Ser. No. 315,275 filed Oct. 26, 1981, U.S. Pat. No. 4,372,563, by Robert J. Diehl et al. The packing support shown therein utilizes two annular rings adapted to be sleeved about a casing for supporting a plurality of packing elements thereon. A first ring is initially secured to the casing with set screws and has deformable gripping fingers. The fingers are wedged radially inward to further secure the packing support to the casing by means of a second ring which is threaded onto the exterior of the first ring. The gripping force is determined by the amount of rotation of the second ring relative to the first ring. However, under certain service conditions it is difficult to obtain a secure attachment of the packing support to the casing due to the extremely high rotational forces required to wedge the fingers to a secure engaging relationship with the casing. Also, on occasion, the set screws initially holding the first ring to the casing break loose because of the high rotational forces required to seat the second ring onto the gripping fingers of the first ring thereby allowing both rings to rotate about the casing and creating an unsecure packing support apparatus.

SUMMARY OF THE INVENTION

It is therefore an object of the invention to provide a packing support apparatus which can be securely mounted to an external wall of a casing without the need for piercing the casing wall or welding thereto, and without connection to any other member, such as a surrounding wellhead bore or outer casing, and is capable of supporting a set of packing rings or other apparatus in an annulus cavity such as between a casing and a wellhead.

It is also an object of the invention to provide a packing support apparatus in which it is unnecessary to apply rotational forces to the circumference of the support ring due to the possibility of these forces causing the support apparatus to spin or rotate about the casing thereby creating an unsecure packing support apparatus.

It is a further object of the invention to provide a packing support apparatus which is small and compact so that it is capable of replacing packing supports presently used in the oil and geothermal well industry.

A packing support assembly is provided which is sleeved about a well casing, or the like, and secured thereto without the need for piercing the casing wall or welding thereto. The packing support apparatus comprises a support ring which is sleeved about the casing and secured thereto by a gripping means in the form of a plurality of clamping segments adapted to grip the external wall of the casing. The clamping segments are held in an unactuated position by retaining screws which secure the clamping segments to the interior of the support ring. Activation of the support ring is accomplished by use of a plurality of activating pins which are threadably received into the bottom of the support ring. The clamping segments are provided with external wedging surfaces which slidably engage cooperating wedging surfaces on the interior of the support ring such that upon rotation of the activating pins the clamping segments are wedged radially inwards so that they securely engage or grip the casing. The gripping force is adjustable as determined by the order and degree of rotation of the activating pins. The upper annular edge of the support ring is configured to support an annular packing, or the like, thereon.

BRIEF DESCRIPTION OF THE DRAWINGS

In the accompanying drawings which form part of the specification and are to be read in connection therewith.

DETAILED DESCRIPTION OF THE INVENTION

Figure 1:
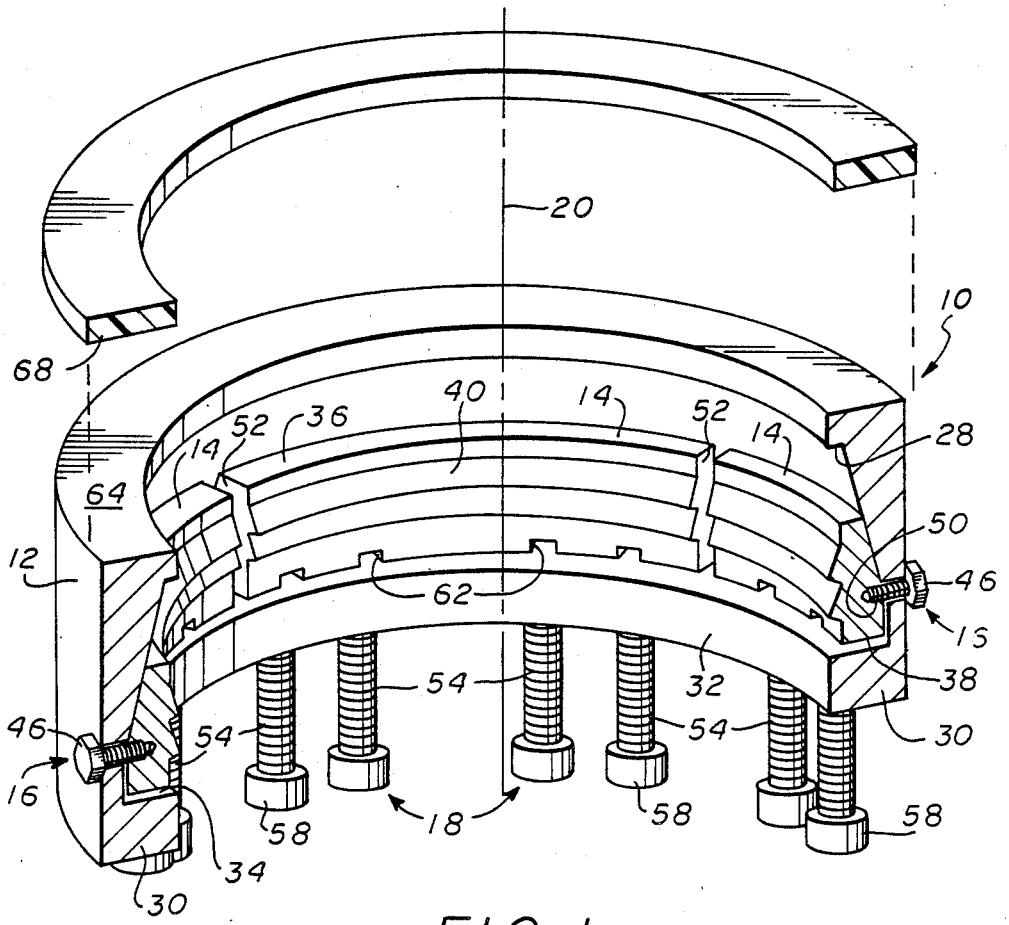
FIG. 1 is a partially exploded view showing the invention in cross-section and in perspective.
Figure 2:
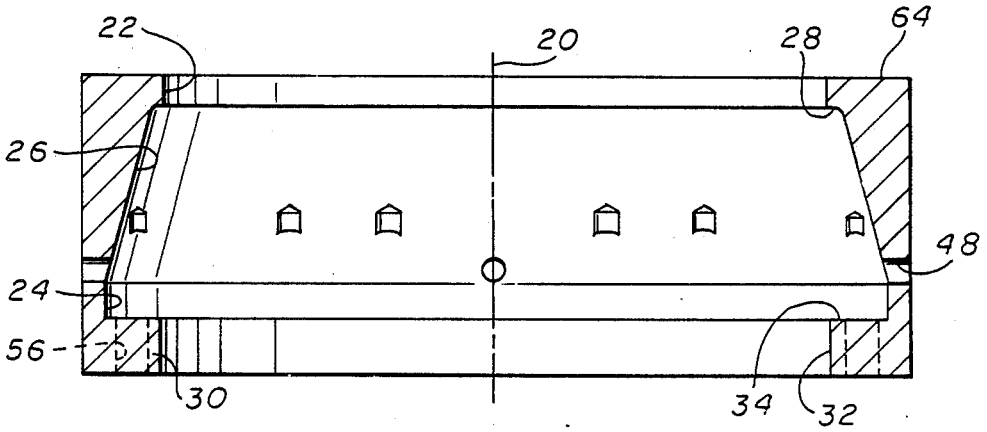
FIG. 2 is a view of the support ring of the invention, in vertical cross-section through a diameter thereof.

Referring more particularly to the drawings, there is shown in FIG. 1 a partially exploded view of a packing support apparatus 10 which represents a preferred embodiment of the invention. The support apparatus 10 is comprised of a support ring 12 in the general form of an annular cylindrical member of circular cross-section, a plurality of arcuate clamping segments 14 substantially forming a circle on the inner surface of the support ring 12, a plurality of retaining means 16 for securing the clamping segments 14 to the support ring 12, and a plurality of actuating means 18 for moving the clamping segments 14 from an unactivated position in the support ring to an activated position gripping a casing "C".

As best shown in FIGS. 1 through 4, the support ring 12 has a central axial bore 20 therethrough. The support ring 12 includes an upper end section provided with a central circular bore 22 of slightly larger bore diameter than the outside diameter of the casing "C," and an intermediate section provided with a central circular bore 24 of a greater bore diameter than the upper bore section 22. The bore wall between the intermediate bore section 24 and the upper bore section 22 defines a frusto-conical surface 26 convergent inwardly towards the upper bore section 22 and terminates at a downwardly facing shoulder 28 in the axial bore of the support ring 12 immediately below the upper bore section 22. In the particular embodiment of the invention shown herein, the frusto-conical surface 26 is defined by a cone angle of 30° which corresponds to an angle of 15° from the vertical plane and axes. The support ring 12 further includes a lower end section with an inwardly extending annular lip 30 having a central circular bore 32 of substantially the same diameter as the upper bore section 22. The lower annular lip 30 of the support ring 12 defines an upwardly facing shoulder 34 in the axial bore of the support ring 12.

Figure 5:
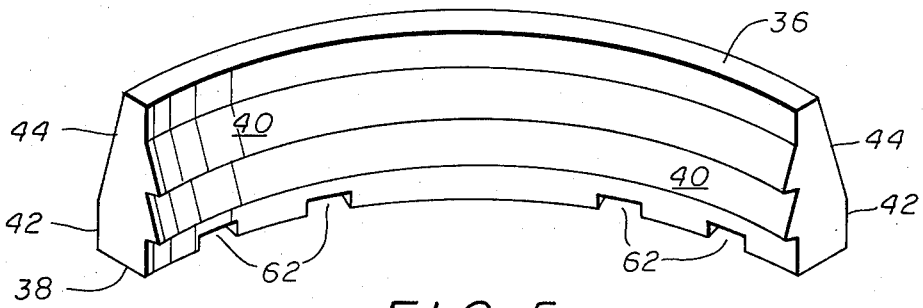
FIG. 5 is a perspective view of a clamping segment.
Figure 6:
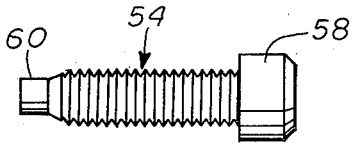
FIG. 6 is a plan view of an activating pin.

The packing support apparatus 10 further includes a plurality of arcuate clamping segments 14 arranged on the inner peripheral surface of the support ring 12 in a generally circular pattern. In the particular embodiment of the invention shown herein and as best shown in FIGS. 1 and 5, there are four clamping segments 14, each forming approximately 90° of a circle. Each clamping segment 14 has an upper and lower end section provided with planar end surfaces 36 and 38, respectively, which reside in radial planes perpendicular with the central axis of the support ring 12. Intermediate its end sections 36 and 38, the clamping segment 14 has an internal peripheral surface having gripping means formed thereon in the form of a number of serrations (40). The clamping segment 14 has an external peripheral surface including a lower cylindrical wall 42 extending substantially co-axial with the central axis 20 of the support ring 12, and an upper surface 44 in the form of a frusto-conical section extending from the upper limit of the cylindrical wall 42 in a converging direction to the upper end surface 36. The frusto-conical surface section 44 is defined by a cone angle of 30° which corresponds to an angle of 15° from the vertical plane and axis, and is adapted to slidingly engage the inner frust-conical surface 26 of the support ring 12.

Figure 3:
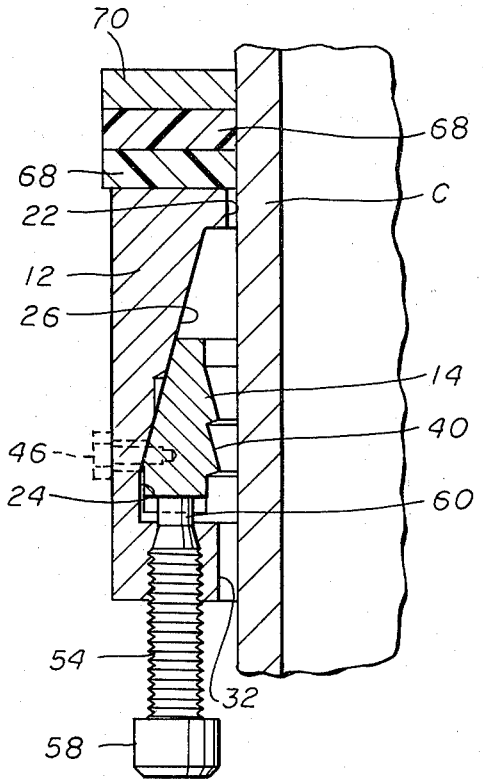
FIG. 3 is a fragmentary view in vertical cross-section illustrating the packing support apparatus sleeved about a well casing with the clamping segments held in an unactivated position by retaining screws.

As shown in FIGS. 1 and 3, the packing support apparatus includes a plurality of retaining means 16 for securing the clamping segments 14 to the support ring 12. The retaining means 16 includes retaining screws 46 received in radial bores 48 located circumferentially about the support ring 12 extending from its external peripheral surface of the inner frusto-conical surface 26, and the retaining screws 46 are threadably received in threaded bores 50 located in the external frusto-conical surface sections 44 of the clamping segment 14. In the particular embodiment of the invention shown herein, there are four retaining means 16, one for each clamping segment 14 and they are circumferentially and equiangularly spaced about the support ring 12 so that the clamping segments 14 are retained about the inner periphery of the support ring 12 substantially forming a circle. The clamping segments 14 are secured about the inner periphery of the support ring 12 such that small gaps 52 exist between the adjacent ends of each segment 14 and in such a manner that the serrated gripping means 40 of the clamping segments 14 will not control the casing "C" or will remain in an unactivated position when the support apparatus 10 is sleeved about the casing "C".

The packing support apparatus 10 also includes a plurality of activating means 18 for moving the clamping segments 14 from an unactivated position in the support ring 12 to an activated position whereby the clamping segments 14 are securely gripping the casing "C". As shown in FIGS. 1, 3, 4 and 6, the activating means 18 includes activating pins 54 which are threadably received in threaded bores 56 circumferentially located around the lower annular lip 30 of the support ring 12. The bores 56 extend from the bottom of the lip 30 to the upwardly facing shoulder 34 with their axes substantially parallel to the central axis of the support ring 12. The pins 54 extend through the bores 56 and contact the bottom end surfaces 38 of the clamping segments 14. One end of the pin 54 has a head 58 providing means for manual rotation of the pin 54 and the other end has a non-threaded reduced diameter portion 60. The bottom end surfaces 38 of the clamping segments 14 have slots 62 formed therein extending radially from the central axis of the support ring 12. Each slot 62 receives the reduced diameter portion 60 of one activating pin 54. The slots 62 guide the radially inward movement of the clamping segments as they are moved into an activated position gripping the casing "C". In the particular embodiment of the invention shown herein, there are sixteen activating pins 54, four for each clamping segment 14, located circumferentially about the annular lip 30 of the support ring 12.

Figure 4:
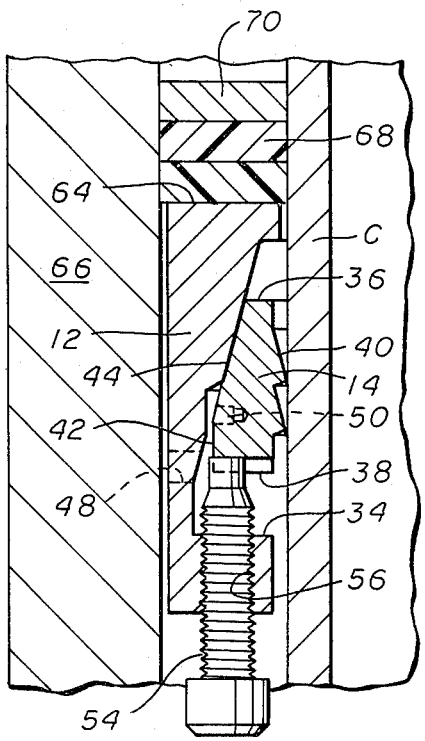
FIG. 4 is a fragmentary view in vertical cross-section, illustrating the packing support apparatus as installed between a well casing and wellhead bore and supporting a packing assembly, the clamping segments are shown in the actuated position gripping the casing.

To activate the packing support apparatus 10 as shown in FIG. 4, the activating pins 54 are screwed into the bores 56 in the lip 30 of the support ring 12 until the pins 54 contact the slots 62 in the clamping segments 12. Then, the retaining screws 46 are removed from the support ring 12 thereby freeing the clamping segments 14 for movement. Upon further manual rotation of the activating pins 54, the clamping segments are pressed upwards, and the frusto-conical surface sections 44 of the clamping segments 14 slidingly engage the frusto-conical surface 26 of the support ring 12. The engagement between the frusto-conical surfaces 44 and 26 act to wedge the clamping segments 14 radially inwards and the engagement between the pins 54 and radial slots 62 act to prevent the segments 14 from shifting laterally about the circumference of the casing "C" or the support ring 12. The gaps 52 between the clamping segments 14 allow the segments to move radially inward towards the casing "C" without binding the adjacent ends of the segments 14. Accordingly, the serrated portions 40 on the inner surfaces of the clamping segments 14 act as gripping surfaces or teeth which bite into the exterior of the casing "C" to provide the packing support apparatus 10 with a secure attachment to the casing "C", or similar element. For some applications the shoulder 28 provides a stop to limit the relative movement of the clamping segments 14 or the support ring 12.

The packing support apparatus 10 is provided with an annular edge surface 64 at the upper end of the support ring 12 extending substantially perpendicular to the central axis of the support ring 12 for supporting a packing structure. In FIG. 4, the packing support device 10 is shown installed on a casing "C" in a typical application for supporting a packing structure in a wellhead 66. Such a packing structure typically consists of one or more stacked sealing or packing rings 68 and a metal retainer 70. The lower face of the packing ring 68 seats on the upper edge surface 64 of the support ring 12. The packing is adapted to provide a seal between the casing "C" exterior and the interior of the wellhead bore 66. Conventionally, the packing rings 68 are subjected to compressive forces which cause their lateral radial expansion into a sealing engagement with the casing "C" and the inner bore of a wellhead 66. The compression forces may be applied by various means such as by a sleeved element around the casing which is urged downwardly against the top of the packing or possibly by a clamping means such as a bolt through the metal retainer 70 and packing rings 68 into the support ring 12.

A unique packing support apparatus is disclosed herein which can be installed on the smooth unthreaded external wall of a casing or tubing for supporting a packing or the like, without need for welding thereto or for piercing the walls of the casing or tubing. It is adapted to be secured to the casing without attachment or reliance on any other structural element such as an outer casing or wellhead. It is also provided with an adjustable gripping means for securely anchoring the apparatus onto a casing. The gripping means is accomplished without utilizing any circumferential rotational forces upon the support ring 12 which may tend to cause the support apparatus to rotate about the casing thereby creating an unsecure support apparatus. Further, the apparatus disclosed herein is sufficiently small and compact so that it is capable of replacing packing supports presently used in the oil and geothermal well industry.

It is to be understood that the foregoing description of a preferred embodiment of the invention has been presented for purposes of illustration and description and is not intended to limit the invention to the precise form disclosed. For example, the cone angle which defines the frusto-conical surfaces 26 and 44 could be other than 30°. It has been determined that cone angles from 16° to 40° or a corresponding 8° to 20° angle from the vertical plane and axis provides optimal engagement between the clamping segments 14 and support ring 12 such that the segments 14 obtain the maximum wedging force with the minimum actuating pin 54 rotation. Also, the number of clamping segments 14, retaining screws 46 and activating pins 54 may be varied. Further, while the invention has been illustrated with respect to supporting a packing, it can obviously be used to support other elements and devices on a casing and tubing or mandrel, as the case may be. It is to be appreciated therefore, that such changes may be made by those skilled in the art, without departing from the spirit of the invention.

What is claimed is:

1. A device for supporting a set of packing rings mounted in sleeved relationship between a casing and a wellhead bore comprising:

a support ring of generally cylindrical configuration having a central axial bore with an inside diameter greater than the diameter of the casing so that the ring may be sleeved about the casing, the support ring having an upper bore portion defined by an internal frusto-conical surface which is convergent inwardly toward an upper end of the support ring, the support ring having an intermediate bore portion with an inside diameter greater than the inside diameter of the upper bore portion and a lower bore portion having a depending inwardly extending annular lip defining an upwardly facing shoulder on the top side of the lip;

a plurality of clamping segments of arcuate configuration arranged in a generally circular pattern, each clamping segment having gripping means on its inner arcuate surface and having an external arcuate surface defining a frusto-conical configuration convergent toward the upper end of the clamping segment, the external frusto-conical surfaces having a common conical axis and being defined by a cone angle substantially equal to the cone angle which defines the internal frusto-conical surface of the support ring;

a plurality of releasable retaining means for securing the clamping segments to the inside of the support ring in an unactivated position so that when the support ring is sleeved about the casing the gripping means does not contact the casing, the clamping segments being received retained inside the support ring such that small gaps exist between the adjacent segments; and activating means received through the bottom of the inwardly extending annular lip of the support ring for pressing the clamping segments upward upon release of the retaining means so that the coacting frusto-conical surfaces of the segments and support ring act to wedge the clamping segments radially inward allowing the gripping means to contact the casing, the gripping means engaging the casing so that the clamping segments and support ring are secured to the casing.

2. A device as defined in claim 1, wheein the annular upwardly facing surface at the upper end of the support ring is for supporting a packing means thereon comprised of a plurality of packing rings whereby the packing rings are adaptable for sealing between the casing and an inner wall of the wellhead disposed thereabout.

3. A device as defined in claim 1, wherein the gripping means of the clamping segments are formed by a plurality serrations cut into the inner surface of the clamping segments.

4. A device as defined in claim 1, wherein each retaining means comprises a screw being received through a bore extending from an external surface to the internal surface of the support ring and being threadably received in the external surface of the clamping segment so that the clamping segments are secured to the support ring in an unactivated position.

5. A device as defined in claim 1, wherein the activating means comprises a plurality of threaded activating pins located circumferentially about and threadably received through the bottom of the annular lip of the support ring, each clamping segment having a plurality of slots on the bottom thereof corresponding to the number of activating pins extending perpendicular to the central axis of the support ring and receiving the ends of the activating pins so that upon rotation of the pins the clamping segments are forced upward and the coactive frusto-conical surfaces of the segments and support ring act to wedge the gripping means radially inward into securing contact with the casing, the slots guiding the clamping segments during the wedging action of the clamping segments and support ring.

* * * * *